United States Patent [19]

Faw

[11] Patent Number: 4,463,532

[45] Date of Patent: Aug. 7, 1984

[54] PREFABRICATED WALL UNIT FOR LOG BUILDING CONSTRUCTION, METHOD OF PRODUCING SAME AND METHOD OF CONSTRUCTING LOG BUILDING THEREWITH

[75] Inventor: Garland Faw, Kannapolis, N.C.

[73] Assignee: Precision Interlock Log Homes, Inc., Mooresville, N.C.

[21] Appl. No.: 278,051

[22] Filed: Jun. 29, 1981

[51] Int. Cl.[3] ..... E04B 1/10

[52] U.S. Cl. ..... 52/233; 52/747

[58] Field of Search ..... 52/233, 747, 404, 274, 52/264

[56] References Cited

U.S. PATENT DOCUMENTS

| | | | |
|---|---|---|---|
| 1,445,738 | 2/1923 | Adams | 52/233 X |
| 2,320,466 | 6/1943 | Presley | 52/233 X |
| 2,350,904 | 6/1944 | King | 52/264 X |
| 2,563,703 | 8/1951 | Bonney | 52/233 X |
| 3,166,802 | 1/1965 | Schmidgall | 52/309.4 X |
| 3,460,301 | 8/1969 | Davis | 52/233 |
| 3,769,065 | 10/1973 | Dunn | 427/215 X |
| 4,056,906 | 11/1977 | Elfstrom | 52/747 X |
| 4,214,408 | 7/1980 | Rich, Jr. | 52/747 X |
| 4,320,610 | 3/1982 | Rupp | 52/233 |

FOREIGN PATENT DOCUMENTS 2615891 4/1976 Fed. Rep. of Germany ..... 52/233

OTHER PUBLICATIONS

*American Builder*, "Log Cabins", Feb. 1933, p. 33.

*Primary Examiner*—Carl D. Friedman

*Attorney, Agent, or Firm*—Richards, Shefte & Pinckney

[57] ABSTRACT

A prefabricated wall unit for log building construction is produced on a specially-constructed assembly frame by sequentially stacking a plurality of individual log units co-planarly and joining each log unit in sequence to the previously stacked log unit by lag bolts driven through the log units to integrate the logs in the wall unit. Longitudinal studs are affixed in relatively spaced relation to one side of the integrated logs and supplementary insulation is sprayed between the studs. A plurality of wall units are vertically arranged in relative abutting relation on and affixed to a conventional building foundation to produce a log structure, the wall units being joined to each other by the interdigitation of respective log units of abutting wall units and the driving of lag bolts through such interdigitated log units.

19 Claims, 8 Drawing Figures

FIG. 1
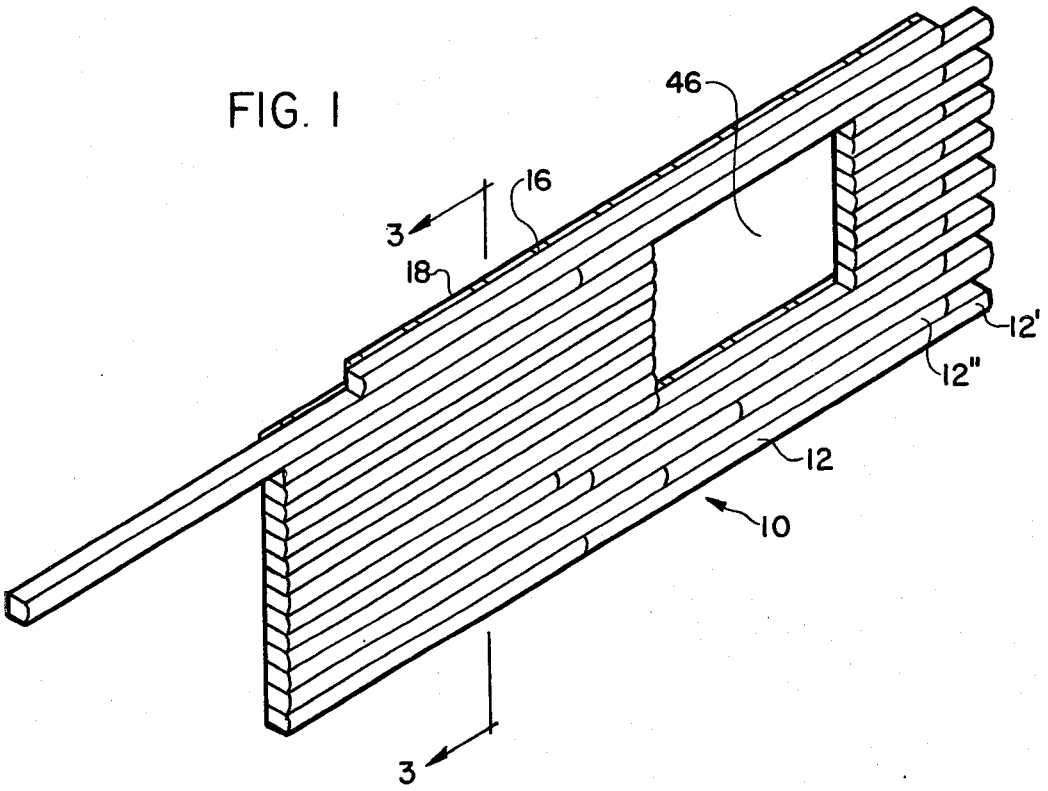
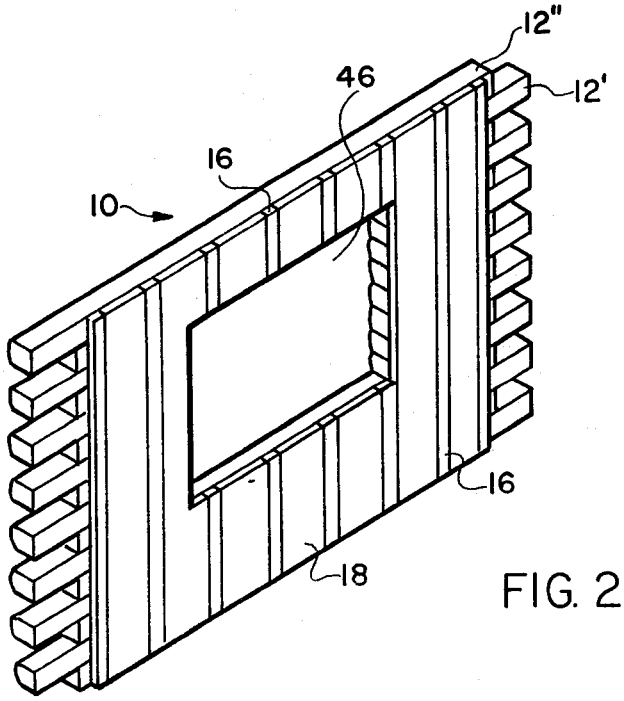
FIG. 2

PREFABRICATED WALL UNIT FOR LOG BUILDING CONSTRUCTION, METHOD OF PRODUCING SAME AND METHOD OF CONSTRUCTING LOG BUILDING THEREWITH

BACKGROUND OF THE INVENTION

For centuries wooden logs from felled trees have been utilized in the construction of the walls of buildings. Because of the natural insulative properties of wood and because of the aesthetically pleasing rustic appearance logs provide, logs have in recent years been increasingly used in building construction, particularly homes. According to contemporary improvements developed in the art of log building construction, log units of uniform shape and dimensions produced by the controlled machining of wooden logs are conventionally used and provide significant advantages over the relatively primitive method of construction using felled and delimbed trees.

Characteristically, the manufacturers of such machined log units market the log units in unassembled lots of individual log units for transportation to a construction site and assembling thereat. As is conventional, the assembling of individual log units ordinarily involves the vertical stacking thereof, most manufacturers machining their log units in such a manner as to facilitate stacking arrangement thereof. To provide structural integrity to walls constructed of stacked log units, the log units are rigidly affixed to one another during the construction process, normally by driving spikes, lag bolts, or the like through each log unit into the previously stacked log unit following the stacking thereof on such previously stacked log units, and, because the log units are usually formed of green wood, it is necessary that a sufficient number of spikes be used at relatively small spacings along the lengths of the stacked log units to prevent warping, bowing or buckling of the log units which can deleteriously affect both the structural integrity and appearance of the building and negate the effectiveness of the log units as insulation. Experience has shown, however, that the purchasers and assemblers of log unit packages often do not follow recommended instructions concerning the affixation of log units in this manner, and significant problems have arisen in the log building industry as a result since the purchasers of the log unit packages typically place the blame on the manufacturer when the log units in the building begin to warp, bow or buckle as a result of such improper assembly.

It will also be understood that the conventional method of log building construction of stacking and affixing individual log units one-by-one is a labor intensive operation, and accordingly, is costly. As a result, the cost of the conventional practice of initially constructing the exterior shell in the above manner and thereafter affixing interiorly thereto studs, additional insulation and wallboard is often prohibitive.

The present invention provides a solution to the abovedescribed problems in providing a prefabricated wall unit for log building construction and a method of economically constructing such wall units complete with studs and supplemental insulation at the log unit manufacturing facility whereby the proper fabrication of the walls of log buildings can be controlled by the manufacturer without increasing the total cost to the purchaser of log building construction.

SUMMARY OF THE INVENTION

Briefly described, the present invention according to one aspect thereof provides a prefabricated wall unit adapted for connection with like wall units in log building construction, comprising a plurality of longitudinally extending log units arranged and joined co-planarly in stacked relationship along respective longitudinal surfaces thereof and a plurality of longitudinal studs affixed in spaced relationship to one side of the plurality of log units transversely of the longitudinal extents thereof.

Each log unit includes four longitudinally extending exterior surfaces including two substantially flat stacking surfaces extending in opposed parallel relation, a substantially flat interior wall surface extending perpendicularly between the stacking surfaces and a generally rounded exterior wall surface extending between the stacking surfaces in opposed relative to the interior wall surface, and each log unit having a plurality of bores extending transversely therethrough between the stacking surfaces and spaced along the longitudinal extent of the log unit adjacent opposite longitudinal sides thereof for receiving threaded screws for joining together each pair of adjacently stacked log units. According to the preferred embodiment, the respective bores of each log unit of each pair of adjacently stacked log units are staggered in relation to the bores of the other log unit of the pair thereby to prevent interference between the respective screws through each log unit.

The spaced studs are affixed to the side of the wall unit formed by the flat surfaces of the log units and, as will be understood, thereby facilitates the affixation of a suitable wall covering to the wall unit while also defining a plurality of spacings between the wall unit and any such wall covering for receipt of insulative material, preferably a layer of a composition of expanded perlite.

It is also preferred that the respective ends of the plurality of log units forming one end of the wall unit are arranged in alternatingly staggered relationship, with the end faces of alternate log units being essentially aligned with each other and with the end faces of intermediate log units being essentially aligned with each other and in staggered relation with respect to the end faces of the alternate log units. In this manner, the one end of the wall unit may be joined with the like end of a like wall unit to form a building corner of mortise-and-tenon appearance.

According to another aspect of the present invention, a method of forming a prefabricated wall unit of the above construction is provided, including the steps of sequentially stacking a plurality of individual longitudinally extending log units co-planarly along respective longitudinal surfaces thereof; rigidly joining each log unit in sequence to the immediately preceding stacked log unit by driving the aforementioned threaded screws into such pair of adjacent log units; and affixing to one side of the stacked log units the aforesaid plurality of longitudinal studs in spaced relationship and transversely of the longitudinal extents of the stacked log units.

According to the preferred embodiment, an inclined log support frame is provided to facilitate the performance of such method, the log units being sequentially arranged on the frame in an inclined plane with the flat interior wall surfaces of the log units abuttingly against the frame. The log units are initially prepared prior to stacking on the frame by drilling in each log unit the aforementioned plurality of bores at spaced and staggered locations as described above. As the log units are sequentially stacked, the respective end faces of alternate and intermediate log units are respectively arranged in staggered relation as described above. It is also preferred that, following the affixation of the plurality of studs, a layer of an adherent expanded perlite composition is sprayed onto the one side of the stacked log units between the studs to a thickness at least equal to the outwardly extending dimension of the stud from the wall unit and then smoothed to form a generally planar surface.

The present invention also provides a method of constructing a log building from the above-described prefabricated wall units including the steps of initially forming a plurality of such wall units according to the above method, constructing a building foundation and floor for supporting the wall units, arranging the wall units vertically on the floor with the ends of adjacent wall units in abutment with one another and with the flat side of each wall unit facing inwardly, rigidly affixing each wall unit to the floor by attaching bracket means to each wall unit and the floor, and rigidly connecting the wall units to one another by driving threaded screws through the respective log units of abutting wall units. In the preferred embodiment, the wall units having alternatingly staggered log units are joined together by interdigitating the alternatingly staggered ends of the respective alternate and intermediate log units of the wall units, thereby to provide corner joints of mortise-and-tenon appearance. The threaded screws are driven alternatingly through the ends of alternate log units of each wall unit having alternatingly staggered log units into the interdigitated intermediate log units of each wall unit joined therewith.

BRIEF DESCRIPTION OF THE DRAWINGS

FIG. 1 is a perspective view of a prefabricated wall unit according to the preferred embodiment of the present invention taken from the exterior side thereof;

FIG. 2 is a perspective view of another prefabricated wall unit according to the preferred embodiment of the present invention take from the interior side thereof;

DESCRIPTION OF THE PREFERRED EMBODIMENT

Figure 3:
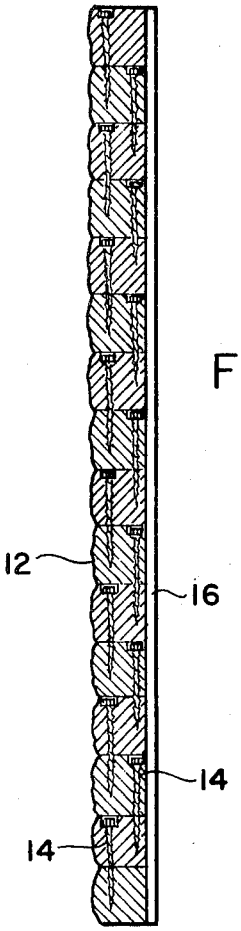
FIG. 3 is a vertical cross-sectional view of the wall unit of FIG. 1 taken along line 3—3 thereof.

Referring now to the accompanying drawings, two log wall units according to the present invention are illustrated respectively in FIGS. 1 and 2 and generally indicated at 10. Each wall unit 10 is formed in a particular manner hereinafter described to include a plurality of longitudinally extending log units 12 arranged and joined co-planarly in stacked relation, each pair of adjacently-stacked log units 12 being joined by a plurality of conventional threaded lag bolts 14 (FIG. 3) spaced along the lengths thereof and drivenly extending therethrough transversely of the longitudinal extents thereof, thereby integrating the plurality of log units 12. One side of each wall unit 10 is substantially flat for use as an interior wall surface of a structure according to the present invention, a plurality of longitudinal studs 16, preferably conventional two inch square wooden strips, being nailed or otherwise affixed in spaced relation to the flat surface substantially perpendicularly of the longitudinal extents of the log units 12 to facilitate affixation of any suitable wall covering to the wall units 10 of a finished structure. A layer of insulative material 18, preferably a material which can be adheringly sprayed such as a composition of expanded perlite as disclosed in U.S. Pat. No. 3,769,065, is bonded to the flat surfaces of the wall units 10 between the studs 16 to provide additional insulation. As determined by the predetermined intended location of the wall units 10 in a finished building structure, the respective ends of the log units 12 forming one or both ends of a wall unit 10 may be arranged in alternatingly staggered relationship, with the end faces of alternate log units 12' being essentially aligned with each other and with the end faces of intermediate log units 12'' being essentially aligned with each other and in staggered relation with respect to the end faces of the alternate log units 12'. In this manner, the similarly formed ends of two wall units 10 may be joined to form a building corner of mortise-and-tenon appearance as will hereinafter become apparent.

Figure 4:
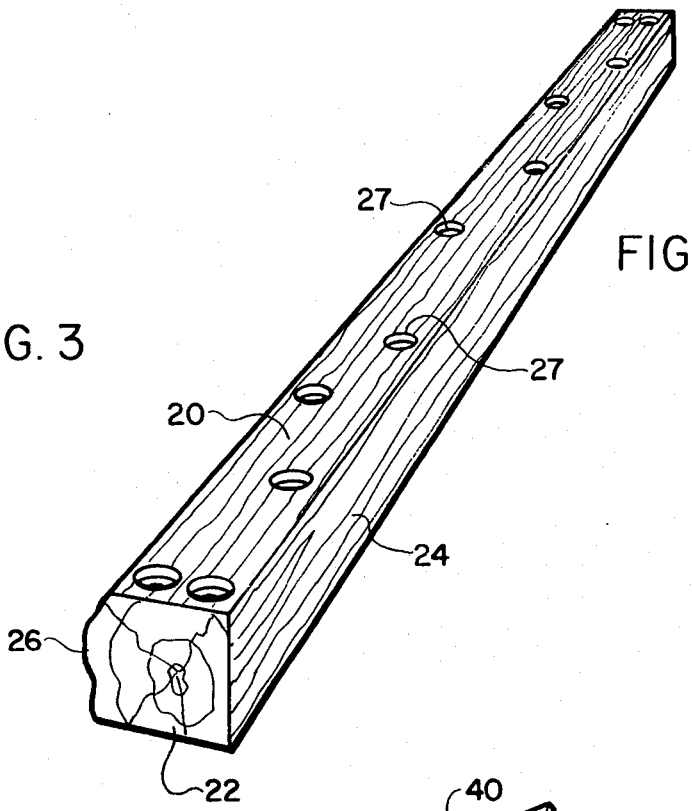
FIG. 4 is a perspective view of an individual log unit according to the preferred embodiment of the present invention for use in the wall units of FIGS. 1 and 2.

A log unit 12 of the type utilized in the preferred embodiment of the present invention is illustrated in FIG. 4. As can readily be seen, the log unit 12 is of a generally conventional type machined to predetermined dimensions and a predetermined shape, having four longitudinally-extending surfaces including opposed, substantially flat upper and lower parallel surfaces 20, 22, respectively, to readily facilitate vertical stacking of a plurality of the log units 12, a substantially flat interior wall surface 24 extending substantially perpendicularly transversely between the stacking surfaces 20,22, to facilitate the formation of the aforementioned flat interior wall surface on one side of a finished wall unit 10, and a generally-rounded exterior wall surface 26 of a natural log appearance extending transversely between the stacking surfaces 20,22 in opposed relation to the interior surface 24 to provide the formation of an exterior wall surface of a finished wall unit 10 having a rustic appearance of the type typically associated with log structures. In accordance with the present invention, each log unit 12 is prepared for use, following the machining thereof, by drilling of a plurality of countersunk bores 27 extending substantially transversely therethrough between the stacking surfaces 20,22 thereof for receipt of the lag bolts 14 as will hereinafter be more fully described. The bores 27 are relatively closely spaced along the longitudinal extent of the log unit 12 and preferably are located alternately adjacent the opposed interior and exterior wall surfaces 24,26, with a pair of such bores 27 being formed at each longitudinal end of each log unit 12.

Figure 5:
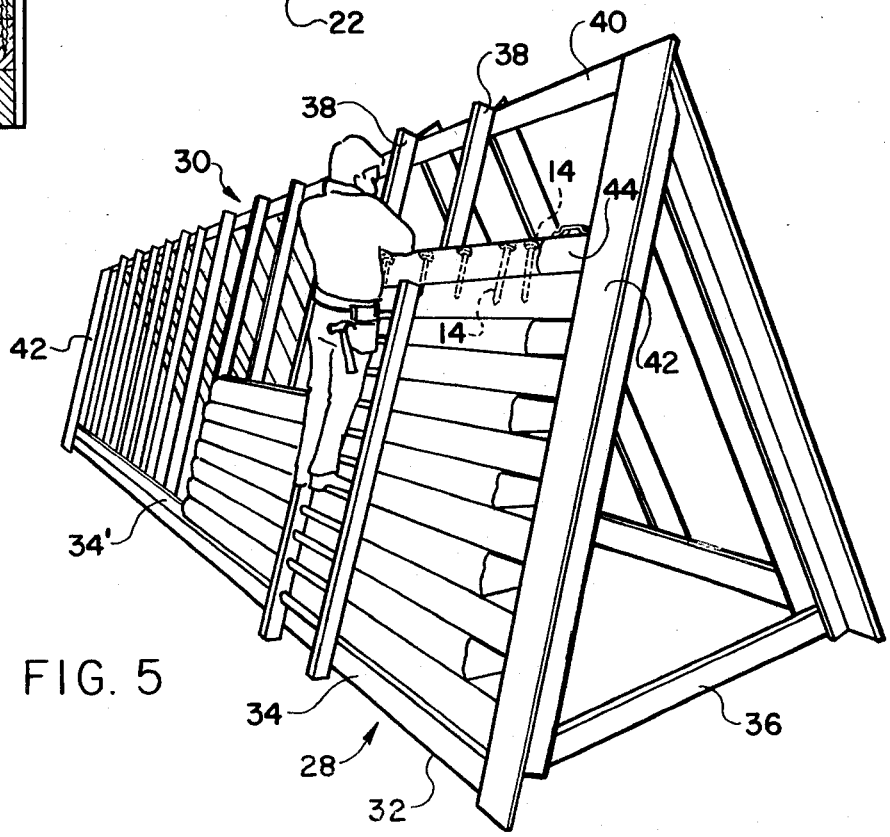
FIG. 5 is a perspective view of the assembly frame utilized in the method of the present invention for forming wall units of the type of FIGS. 1 and 2, illustrating a wall unit in the process of fabrication.

An important aspect of the present invention is that the wall units 10 are fabricated by the log manufacturer at its manufacturing facility and later joined with other prefabricated wall units 10 at a construction site to form the exterior shell of a building structure as opposed to the conventional construction method of stackingly arranging and joining individual log units one-by-one at the construction site. As will be understood, the conventional method of individually stacking and joining log units at a construction site is a tedious, time-consuming and labor-intensive procedure. As a solution to this problem, the present invention provides a method of constructing the above-described wall units 10 which not only is substantially less time-consuming but also provides significant improvements in the accurateness and quality of the construction of the finished wall and the completed building structure in which it is incorporated. In the ordinary construction of log structures, it is necessary to periodically check each wall during the construction process to insure that the walls are properly vertical or plumb. Relatively close attention to the proper aligning of the ends of the individual log units is also necessary. As will be appreciated, the construction process is greatly slowed by the constant monitoring of these important factors. According to the method of the present invention of prefabricating log wall units 10, the proper plumbing and aligning of the log units 12 is automatically controlled without the necessity and delay of constantly checking such factors. For this purpose, a log wall unit construction frame 28 (FIG. 5) provides an inclined, horizontally-extending log support surface generally indicated at 30 on and against which the log units 12 may be stacked and joined. The frame 28 includes a generally rectangular base 32 having opposed longitudinal base members 34 and transverse cross-support members 36. A plurality of vertical struts 38 extend angularly, convergingly upwardly from the longitudinal base members 34 and join to an upper longitudinal frame member 40. Importantly, one base member 34 provides a log unit support surface 34' on which may be stacked log units 12, the outwardly facing surfaces of the struts 38 extending from such base member 34 being arranged co-planarly such that the stacking of log units 12 on the surface 34' and against the struts 38 will effectively position and maintain the log units 12 co-planarly. At one end of the frame 28, a log end abutment member 42 is affixed in perpendicular relation to the support surface 34' for abutment thereagainst of the end faces of the log units 12 during stacking thereof to properly maintain the end faces in alignment. Preferably, each end of the frame 28 has an abutment member 42 to facilitate the construction of wall units 10 at either end thereof.

Wall units 10 are accordingly constructed on the frame 28 by initially arranging a log unit 12 on the support surface 34' with its lower stacking surface 22 resting in the support surface 34', its upper stacking surface 20 facing upwardly, its flat interior surface 24 in abutment against the struts 38, and its rounded surface facing outwardly of the frame 30. As will be understood, the initial log unit 12 may or may not be abutted directly against the abutment member 42, depending upon whether or not the ends of the log units 12 of the wall unit 10 being constructed are to be alternatingly staggered as described above and, if so, upon the staggered construction of the wall unit 10 with which the wall unit 10 under construction is to be joined. If the wall unit 10 under construction is to have staggered ends and if it is further necessary according to the particular overall construction plans for the structure in which the wall unit is to be used to having the initial log unit 10 staggered inwardly at the end thereof adjacent the abutment member 42 (i.e. as with the left end of the wall unit 10 of FIG. 2), a spacer block 44 of a predetermined short length of a log unit 12 is placed on the support surface 34 in abutment against the member 42 and the initial log unit 12 is abutted against the spacer block 44. The remaining log units 12 are stackingly arranged one-by-one on the frame 28 on the initial log unit 12 in the same manner, the formation of an alternately staggered wall unit end being accomplished when desired by abuttingly positioning the end face of every alternately stacked log unit 12 following the initial log unit 12 in the same manner as the initial log unit 12 (i.e. abutted against the member 42 or against the intermediately positioned spacer block 44) and by abuttingly positioning the end face of the second and every alternately stacked log unit 12 thereafter (i.e. every intermediate log unit 12) in the other manner.

To integrate the log units 12 so that a rigid wall unit 10 is formed, the present invention provides for the direct affixation of each pair of adjacently stacked log units 12. As hereinbefore indicated, each log unit 12 is initially prepared for assembly of the wall unit 10 in which it will be incorporated by drilling therein the countersunk bores 27 and according to the present invention the respective bores 27 of every alternate log unit 12 to be incorporated in any given wall unit 10 are correspondingly located and the respective bores 27 of every intermediate log unit 12 to be incorporated in the wall unit 10 are correspondingly located such that the bores 27 of alternate and intermediate log units 12 will be staggered when the log units are stacked as described above. According to the present invention, following the stacking on the frame 28 of the second and each succeeding log unit 12 in the stacking sequence of the formation of any given wall unit 10 and prior to the stacking of another log unit 12 in such formation, lag bolts 14 are driven through the bores 27 of the log unit 17 just stacked and into the immediately precedingly stacked log unit 12. Thus, by virtue of the location of the bores 27 of the alternate and intermediate log units 12 as above-described, the lag bolts 14 driven through the bores 27 of such log unit 12 threadedly penetrate and engage the non-bored portions of the immediately precedingly stacked log unit 12 to join the adjacent pair of log units 12 without interference with the lag bolts 14 of the preceding log unit 12.

As will be appreciated and readily understood by those skilled in the art, appropriate provision may be made in the initial machining and formation of the log units 12 for any given wall unit 10 for the formation in the wall unit 10 of a suitable opening 46 (FIGS. 1 and 2; see also FIG. 5) in which may be mounted a conventional prehung window (not shown), a door (also not shown), or the like. The selective dimensioning of the log units 12 to provide for such openings and the like is considered to be a matter of design in accordance with conventional practices in the art and is not considered to form any part of the present invention or to be necessary to describe in detail herein.

Once the log units 12 of a wall unit 10 have been stacked and joined on the frame 28 in the above-described manner, the integrated log units 12 are removed from the frame 28 and either stored pending the construction of mating wall units and the beginning of construction of the building structure in which it will be used or may first be further finished to produce a wall unit 10 of the type of FIGS. 1 and 2. As will be understood from the above description, the side of the integrated log units facing inwardly of the frame 28 against the struts 38 is substantially flat. After the removal of the integrated log units 12 from the frame 28, a plurality of the studs 16 may be nailed to the flat wall surface transversely of the longitudinal extents of the stacked log units 12, preferably at spacings of approximately two feet. In this manner, such studs 16 perform a two-fold purpose; one, to best facilitate the affixation of any conventional wall covering to the walls of the finished structure in which the wall unit 10 is to be incorporated and, two, to define a plurality of vertical spacings between the studs 16 for receipt of supplementary insulative material. In this latter regard, it is preferred that the prefabrication of the wall units 10 be completed by spraying onto the flat interior wall surface between the studs 16 a layer of an adherent insulative material of a thickness at least equal to the outwardly-projecting dimension of the studs 16 and then smoothing the insulative material co-planar with the outwardmost surfaces of the studs 16 to form a generally planar interior wall surface. It has been found that an expanded perlite composition of the type described in U.S. Pat. No. 3,769,065 and presently marketed by Perlite Developers of Saint Anne, Ill., best serves the purpose of supplementing the natural insulative properties of the log units 12 in that it can be easily applied by spraying, and a two-inch thick layer thereof provides a substantially greater insulative factor than thicker, more space-consuming layers of virtually any other conventional insulative material. Once the insulative material has adequately set and bonded to the interior wall surface of the wall unit 10, the wall unit 10 is ready for use in the construction of a building structure.

Figure 6:
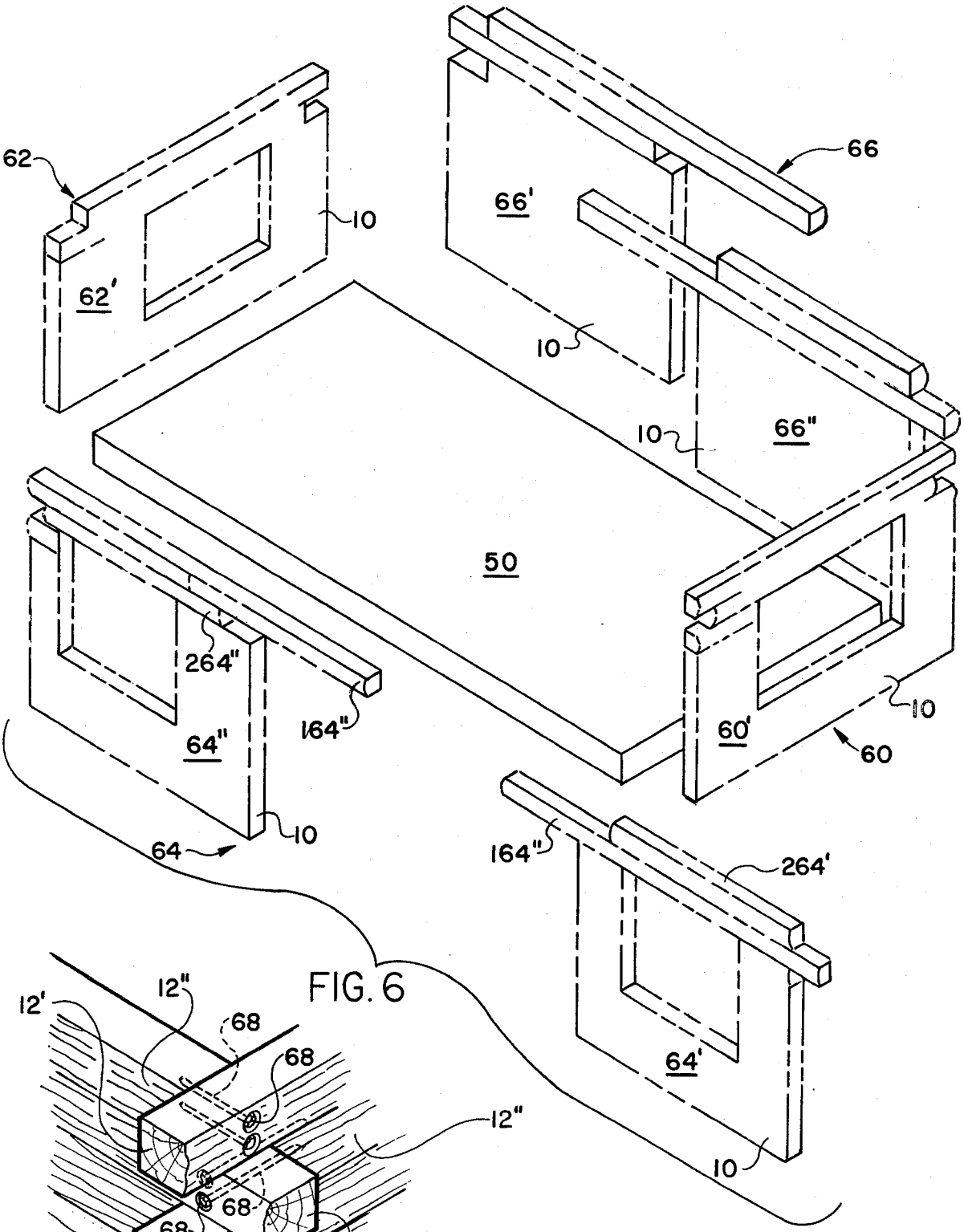
FIG. 6 is a schematic view illustrating in exploded perspective the prefabricated wall units of the present invention utilized to form the walls of a building structure according to the method of construction of the present invention.
Figure 7:
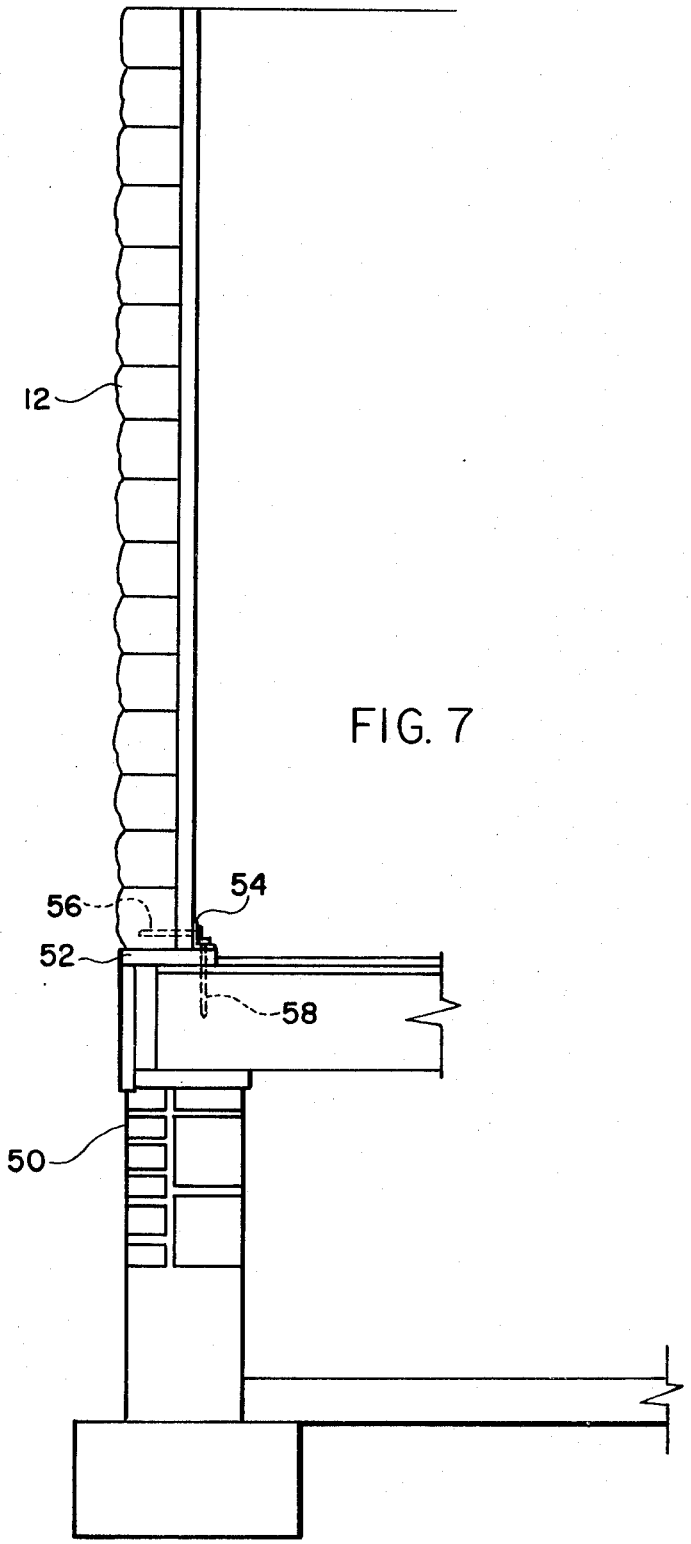
FIG. 7 is a vertical cross-sectional view of one wall of a finished structure constructed according to the method of the present invention.

Referring now to FIG. 6, six wall units 10 necessary for construction of the walls of a relatively simple log structure are illustrated schematically. As in conventional construction, the building formation and flooring, indicated only generally by 50, are initially constructed at the desired building site in a conventional manner. To the flooring about the perimeter of the completed foundation, a conventional sole plate 52 (FIG. 7) is nailed or otherwise affixed to provide a support surface on which may be arranged and to which may be affixed the wall units 10. As will be understood by those skilled in the art, conventional lumber such as two inch by ten inch wooden boards may be utilized for this purpose. Each wall unit 10 is then individually arranged vertically on the sole plate 52 at respective appropriate predetermined locations on the foundation perimeter with the substantially flat interior surface thereof facing inwardly and the rounded exterior surface thereof facing outwardly and is rigidly affixed to the sole plate 52 by conventional angle brackets 54 (FIG. 7) relatively closely spaced along the length of the wall unit 10, a lag bolt 56 being driven horizontally through an appropriate hole in the vertical leg of each angle bracket 54 into the lowermost log unit 12 of the wall unit 10 and another lag bolt 58 being driven vertically through an appropriate hole in the horizontal leg of each angle bracket 54 through the sole plate and into the foundation flooring. As will be appreciated, the wall units 10 are of substantial weight and, accordingly, a conventional crane, hoist or other apparatus is used to lift, position and hold the wall units 10 vertically to facilitate the affixation thereof in the above manner.

It will also be understood that, ordinarily, the erection of the several wall units 10 of any given structure will be performed in the above manner sequentially beginning with any one wall unit 10, preferably at a corner of the structure, and progressing therefrom about the perimeter of the foundation erecting one-by-one the next abutting wall unit 10. With particular reference to FIG. 6, it is seen that the six wall units 10 utilized in the illustrated structure include two opposed side wall units 60',62' each of which respectively form the side walls 60,62 of the structure, and two sets of two wall units, 64',64" and 66',66", which sets respectively form the front and rear walls 64,66 of the structure. By way of example, in the erection of the six wall units of this structure, one of the two front wall units, 64' or 64", would be first erected in the above manner, followed in order by the adjacent side wall unit, the rear wall unit adjacent thereto, the other rear wall unit, the other side wall unit, and finally the other front wall unit. Ordinarily the initially erected wall unit is braced in its affixed vertical position as the next adjacent wall unit is erected and abuttingly joined therewith, as will be explained, to prevent the falling thereof. As will be understood, it is preferred that the two wall units forming a building corner be initially erected as in the example above, rather than the initial erection for instance of the two front wall units 64',64", because the two angularly oriented corner wall unis once erected will provide respective support to each other and to the remainder of the wall units as they are erected.

Figure 8:
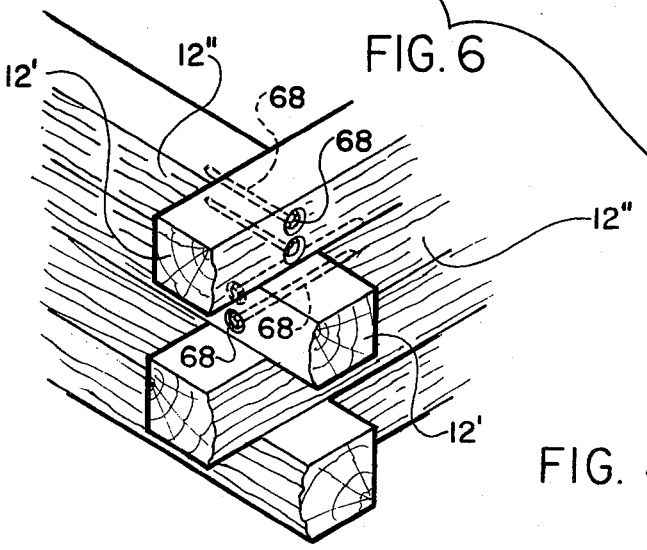
FIG. 8 is a perspective view of an assembled corner joint of a finished structure constructed according to the method of the present invention.

As indicated above, each wall unit erected in sequence following the initial wall unit is abutted with and joined to the adjacent wall unit already erected. The respective abutting ends of corner wall units will be provided with alternatingly staggered log unit end faces as described hereinabove and, as will be apparent, the positioning abutment of these wall units, e.g. wall units 64' and 60' in the exemplary sequence above, in the erection of the structure will be accomplished by interdigitating the alternatingly staggered ends of the respective alternate and intermediate log units of the wall unit being erected with those ends of the log units of the already-erected wall unit with which it abuts, thus providing a corner joint of mortise-and-tenon appearance (FIG. 8). Upon the erection of two corner wall units in this manner, the two wall units are rigidly joined by driving a pair of lag bolts 68 through the ends of the alternate log units of each wall unit into the ends of the intermediate log units interdigitated therewith. Preferably, the lag bolts 68 are countersunk in the surfaces of the alternate log units and are covered by wooden dowel plugs (not shown) inserted in the countersunk bores. The respective wall units jointly forming planar walls, e.g. wall units 64',64" and 66',66", are similarly provided with respective extending log units adapted for interdigitational connection for joinder of such wall units. As can be seen in FIG. 6, the wall units 64',64" and 66',66" are respectively constructed to form therebetween front and rear entranceways. For this purpose and to facilitate the aforementioned interdigitated joinder, the wall unit 64' is provided with an uppermost log unit 164' which terminates short of the inner end of the wall unit 64' and a next uppermost log unit 264' therebelow which extends substantially beyond the inner end of the wall unit 64', the wall unit 64" being oppositely provided with an extending uppermost log unit 164"

and a shortened next uppermost log unit 264'', whereby the wall units 64',64'' may be arranged on the foundation with the respective log units 164',264',164'',264'' thereof abuttingly interdigitated and lag bolts (not shown) may then be driven therethrough to rigidly join the two wall units 64',64''. It will be seen in FIG. 6 that the two rear wall units 66',66'' are similarly constructed for interdigitated joinder. Once the walls 60,62,64,66 of the structure have been erected and joined in this manner, the interior wall surfaces may be finished in any desired manner. If studs 16 and insulation 18 have not been affixed to the wall in the process of fabrication of the wall units, these materials may now be applied, and thereafter any conventional interior wall covering.

The advantages of the present invention will be readily understood from the above specification. Since the wall units 10 are fabricated by the log manufacturer at the factory, the proper joinder of the log units 12 utilizing the requisite number of lag bolts at the proper locations and spacings is insured. Furthermore, the problems existent with conventional log building packages of defective or missing logs being included in a purchased package are eliminated and, accordingly, the customer will be assured of receiving a complete log package. Of equal importance is the reduction by the present invention of the overall cost of log building construction. As discussed above, the conventional manner of log building construction is to sequentially stack individual logs one at a time at a construction site, a time-consuming, labor-intensive and accordingly relatively expensive process. By the present invention, the construction of the wall units 10 may be streamlined into an efficient, assembly-line process thereby greatly reducing the time and labor required therefor. The actual erection of the walls of the log structure by the customer, therefore, is merely a matter of erecting a small number of log wall units 10, which ordinarily can be accomplished in a matter of hours. Thus, although the cost of the building package to the customer will be slightly greater than conventional log building packages, the overall construction cost is significantly reduced. As a result of the efficiency of the process of the present invention and the attendant cost reductions, it now is considerably more practicable to add additional insulative material to the walls of log structures, a step in the construction process which also can be performed by the manufacturer in the fabrication process at reduced costs. As will be appreciated, this represents a significant practical advantage of the present invention in that the application of the supplementary insulation in the prefabrication process permits the cost-efficient assembly-line application of insulative materials such as an expanded perlite composition which ordinarily are relatively expensive when purchased and applied on a per-structure basis and, accordingly, the present invention greatly facilitates the construction of structures of substantially greater than conventional insulative capabilities.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A prefabricated wall unit adapted for connection with like wall units in log building construction, comprising a plurality of longitudinally extending log units arranged co-planarly in stacked relationship along respective longitudinal surfaces thereof with the respective ends of said plurality of log units forming one end of said wall unit arranged in alternatingly staggered relationship, with the end faces of alternate log units being essentially aligned with each other and with the end faces of intermediate log units being essentially aligned with each other and in staggered relation with respect to the end faces of said alternate log units, for joinder of said one end with the like end of a like wall unit to form a building corner of mortise-and-tenon appearance, and said log units being provided respectively with a plurality of bores extending transversely therethrough between the respective longitudinal surfaces thereof at spacings along the longitudinal extents thereof and adjacent opposite longitudinal sides thereof, the respective bores of each log unit of each pair of adjacently stacked log units being staggered in relation to the bores of the other log unit of said pair, each pair of adjacently stacked log units being joined together by plural connecting means extending through the bores of one log unit of said pair and penetrating only the other log unit of said pair, whereby each log unit is directly affixed only to each adjacently stacked log unit and whereby said plurality of log units are rigidly integrated.

2. A prefabricated wall unit according to claim 1 and characterized further in that each log unit includes four longitudinally extending exterior surfaces including two substantially flat stacking surfaces extending in opposed parallel relation, a substantially flat interior wall surface extending perpendicularly between said stacking surfaces and a generally rounded exterior wall surface extending between said stacking surfaces in opposed relation to said interior wall surface.

3. A prefabricated wall unit according to claim 1 and characterized further by a plurality of longitudinal studs affixed in spaced relationship to one side of said plurality of log units transversely of the longitudinal extents thereof for facilitating affixation to said log units of any suitable wall covering and for defining between said wall covering and said plurality of log units a plurality of spacings for receipt by said plurality of log units of insulative material.

4. A prefabricated wall unit according to claim 3 and characterized further by a layer of insulative material bonded to said one side of said plurality of log units between said studs.

5. A prefabricated wall unit according to claim 4 and characterized further in that said insulative material comprises a composition of expanded perlite.

6. A method of forming a prefabricated wall unit adapted for connection with like wall units in log building construction, comprising the steps of:

(a) providing a plurality of individual longitudinally extending log units having a plurality of bores extending transversely therethrough between the respective longitudinal surfaces thereof at spacings along the longitudinal extents thereof and adjacent opposite longitudinal sides thereof, (b) sequentially stacking said log units co-planarly along respective longitudinal surfaces thereof and arranging said log units with the respective end faces of the log units forming one end of the wall unit in alternatingly staggered relation by arranging said respective end faces of alternate log units essentially in alignment with each other and arranging said respective end faces of intermediate log units essentially in alignment with each other and in staggered relation with respect to said end faces of alternate log units and arranging respective bores of each log unit of each pair of adjacently stacked log units in staggered relation to the bores of the other log unit of the pairs, (c) following the stacking and arranging of the second and each succeeding log unit in the stacking sequence, rigidly joining each log unit in sequence to only the immediately preceding stacked log unit including extending plural connection means through the bores of the succeeding log unit and penetrating with said connection means only the immediately preceding stacked log unit, thereby to directly affix each log unit only to each adjacently stacked log unit and thereby to rigidly integrate said log units.

7. A method of forming a prefabricated wall unit according to claim 6 and characterized further in that said stacking includes providing an inclined log support frame and sequentially arranging the log units abuttingly against the frame in an inclined plane.

8. A method of forming a prefabricated wall unit according to claim 7 and characterized further by forming each log unit of said plurality of log units with a substantially flat longitudinally-extending surface, said arranging including positioning the flat surface of each log unit in abutment with the frame.

9. A method of forming a prefabricated wall unit according to claim 6 and characterized further in that said extending includes driving through each said bore and into the immediately preceding log unit a threaded screw.

10. A method of forming a prefabricated wall unit according to claim 6 and characterized further by affixing to one side of the stacked log units a plurality of longitudinal studs in spaced relationship and transversely of the longitudinal extents of the stacked log units.

11. A method of forming a prefabricated wall unit according to claim 10 and characterized further by bonding to the one side of the stacked log units between the studs a layer of insulative material.

12. A method of forming a prefabricated wall unit according to claim 11 and characterized further in that said bonding includes applying to the stacked log units a layer of insulative material of a thickness at least equal to the dimension to which the studs extend from the one side of the stacked log units and then smoothing the insulative material to form a generally planar surface thereof corresponding to the extension of the studs from the stacked log units.

13. A method of forming a prefabricated wall unit according to claim 12 and characterized further in that said applying includes spraying an adherent expanded perlite composition onto the one side of the stacked log units.

14. A method of constructing a log building from prefabricated wall units comprising the steps of:

(a) forming a plurality of prefabricated wall units by (i) providing a plurality of individual longitudinally extending log units having a plurality of bores extending transversely therethrough between the respective longitudinal surfaces thereof at spacings along the longitudinal extents thereof and adjacent opposite longitudinal sides thereof, (ii) sequentially stacking said log units co-planarly along respective longitudinal surfaces thereof and arranging said log units with the respective end faces of the log units forming one end of the wall unit in alternatingly staggered relation by aranging said respective end faces of alternate log units essentially in alignment with each other and arranging said respective end faces of intermediate log units essentially in alignment with each other and in staggered relation with respect to said end faces of alternate log units and arranging respective bores of each log unit of each pair of adjacently stacked log units in staggered relation to the bores of the other log unit of the pairs, (iii) following the stacking and arranging of the second and each succeeding log unit in the stacking sequence, rigidly joining each log unit in sequence to only the immediately preceding stacked log unit including extending first plural connection means through the bores of the succeeding log unit and penetrating with said connection means only the immediately preceding stacked log unit, thereby to directly affix each log unit only to each adjacently stacked log unit and thereby to rigidly integrate said log units (b) constructing a building foundation and floor for supporting said wall units, (c) arranging said wall units vertically on said floor with the ends of adjacent wall units being in abutment with one another and with said wall units having alternatingly staggered log units joined together by interdigitating the alternatingly staggered ends of the respective alternate and intermediate log units of said wall units to provide corner joints of mortise-and-tenon appearance said one side of each said wall unit facing inwardly, (d) rigidly affixing each said wall unit to said floor by attaching bracket means to each said wall unit and said floor, and (e) rigidly connecting said wall units to one another by extending second connecting means horizontally through the respective log units of angularly abutting and interdigitated wall units to form corner joints.

15. A method of constructing a log building according to claim 14 and characterized further in that said stacking includes providing an inclined log support frame and sequentially arranging the log units abuttingly against the frame in an inclined plane.

16. A method of constructing a log building according to claim 14 and characterized further in that said extending of second connecting means includes alternatingly extending threaded screws through the ends of alternate log units of each wall unit having alternatingly staggered log units into the interdigitated intermediate log units of each wall unit joined therewith.

17. A method of constructing a log building from prefabricated wall units according to claim 14 and characterized further in that said forming said wall units includes affixing to one side of the stacked log units a plurality of longitudinal studs in spaced relation and transversely of the longitudinal extents of the stacked log units.

18. A method of constructing a log building according to claim 17 and characterized further by bondingly applying to each said wall unit between the studs thereof a layer of insulative material of a thickness approximately equal to the dimension to which the studs extend from the one side of the stacked log units.

19. A method of constructing a log building according to claim 18 and characterized further in that said applying includes spraying an adherent expanded perlite composition onto the one side of the stacked log units.

* * * * *